United States Patent [19]

Imazeki

[11] Patent Number: 4,760,401

[45] Date of Patent: Jul. 26, 1988

[54] REMOVABLE ROD ANTENNA

[75] Inventor: Kazuyoshi Imazeki, Tokyo, Japan

[73] Assignee: General Research of Electronics, Inc., Tokyo, Japan

[21] Appl. No.: 823,317

[22] Filed: Jan. 28, 1986

[51] Int. Cl.[4] ..... H01Q 1/24

[52] U.S. Cl. ..... 343/702; 343/888; 343/900

[58] Field of Search ..... 343/702, 900, 901, 906, 343/715, 905, 878, 880, 888, 889; 339/126 J, 129, 130 R, 130 C; 403/195, 197; 174/138 A, 152 A, 153 A

[56] References Cited

U.S. PATENT DOCUMENTS

| | | | |
|---|---|---|---|
| 2,524,534 | 10/1950 | Morris et al. | 174/153 A |
| 2,878,303 | 3/1959 | Zacher | 174/153 A |
| 3,142,721 | 7/1964 | Long | 339/126 J |
| 3,408,652 | 10/1968 | Allisbaugh | 343/715 |
| 3,798,651 | 3/1974 | Lehman | 343/702 |
| 3,876,277 | 4/1975 | Colwell | 339/130 C |
| 3,944,722 | 3/1976 | Larsen | 343/715 |
| 3,969,728 | 7/1976 | Hodsdon et al. | 343/702 |
| 3,984,076 | 10/1976 | Van Ordt | 343/715 |
| 4,021,809 | 5/1977 | Klancnik | 343/715 |

FOREIGN PATENT DOCUMENTS

| | | | |
|---|---|---|---|
| 162104 | 9/1983 | Japan | 343/900 |

*Primary Examiner*—William L. Sikes
*Assistant Examiner*—Michael C. Wimer
*Attorney, Agent, or Firm*—Trexler, Bushnell, Giangiorgi & Blackstone, Ltd.

[57] ABSTRACT

A removable rod antenna comprises a first fitting for rigidly coupling to a radio body; an elongate rod-like antenna body; a second fitting of complementary configuration for engaging the first fitting, and a retaining arrangement for holding the second fitting in captive relation on the antenna. Respective mating fastener portions are defined respectively on the first and second fittings for removably engaging each other in electrically conductive contact to thereby removably mount the antenna body to the radio body in electrically conductive contact with the first fitting thereon.

8 Claims, 2 Drawing Sheets

REMOVABLE ROD ANTENNA

BACKGROUND OF THE INVENTION

This invention is directed generally to radio antennas and more particularly to a novel and improved removable rod-type antenna which may be readily attached to a radio body or detached therefrom as desired.

Still more particularly, the invention provides a novel antenna which is adapted to be attached to or detached from the radio body completely manually and without the need for any tool or the like.

Many radio receivers and transceivers are equipped with elongate generally cylindrical rod-type antennas. Many of these antennas are of the telescoping variety. That is, a plurality of decreasing diameter cylindrical sections are telescopically coaxially nested to be extended and retracted to a desired length relative to the radio body. Some of these antennas are mounted so as to allow either partial or complete retraction thereof within the radio body itself. Still others are mounted either rigidly or to flexible spring-like mountings in whip-like fashion and are not retractable. Yet other antennas are mounted pivotally so as to permit folding over thereof with respect to the radio body when not in use and folding back upwardly for telescopic extension when in use.

However, most of these prior art antennas have been non-removably mounted to the radio body. That is, these antennas are not readily manually removable from the body without use of some tools, and some knowledge of the construction thereof to permit removal without damage thereto or to the radio. Moreover, many radio constructions require that the radio body or case be opened or partially disassembled to gain access to the antenna and/or to lead wires connected thereto for disconnection by suitable tools to permit removal of the antenna.

It will be recognized that removal of the antenna may be desirable in many instances. For example, one may desire to install a new antenna of a different type or configuration upon an existing radio. Such replacement may be desirable due to damage or wear of the original antenna, or merely to replace it with an antenna of a different type, higher quality, or the like.

OBJECTS AND SUMMARY OF THE INVENTION

Accordingly, it is a general object of the present invention to provide a manually removable antenna arrangement for a radio receiver or transceiver apparatus.

A more particular object is to provide a manually removable rod antenna in accordance with the foregoing object which may be readily manually assembled or disassembled with the radio body completely manually and without the need for any specialized skill or the use of any tools.

A related object is to provide a manually removable antenna structure in accordance with the foregoing objects which is relatively simple and straightforward to use and highly reliable in operation.

Briefly and in accordance with the foregoing objects, a removable rod antenna according to the present invention comprises first fitting means for rigidly coupling to a radio body; elongate rod-like antenna means for receiving radio signals; second fitting means of complementary configuration for engaging said first fitting means, and retaining means for holding said second fitting means in captive relation on said antenna means. Respective mating fastener means are defined respectively on said first fitting means and said second fitting means for removably engaging each other in electrically conductive contact to thereby removably mount said antenna means to said radio body in electrically conductive contact with the first fitting means thereon.

BRIEF DESCRIPTION OF THE DRAWINGS

The features of the present invention which are believed to be novel are set forth with particularly in the appended claims. The organization and manner of operation of the invention, together with further objects and advantages thereof, may best be understood by reference to the following description taken in connection with the accompanying drawings in the several figures of which like reference numerals identify like elements, and in which:

DETAILED DESCRIPTION OF THE ILLUSTRATED EMBODIMENT

Figure 1:
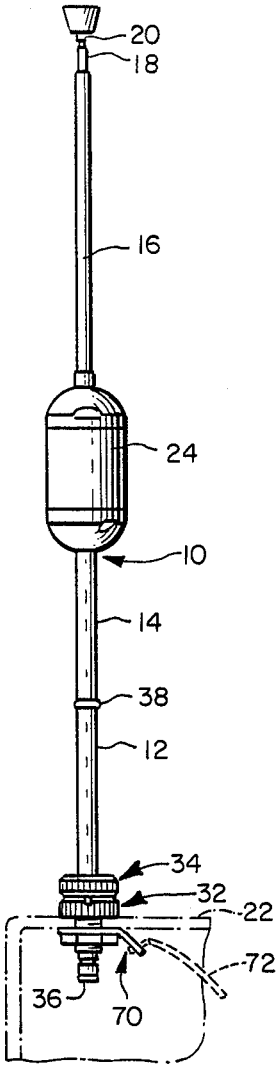
FIG. 1 is an elevational view of a removable rod antenna in accordance with a first embodiment of the invention, with a portion of a radio body to which it is mounted indicated in phantom line.
Figure 2:
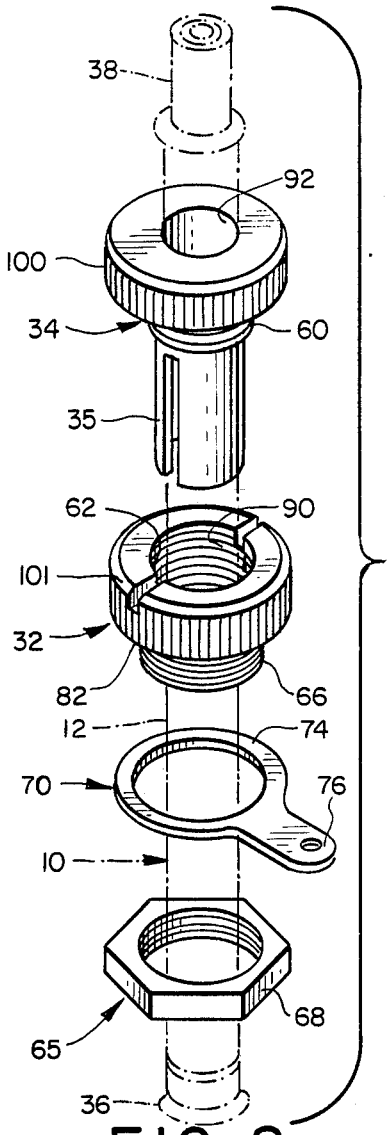
FIG. 2 is an enlarged, exploded partial perspective view of the antenna of FIG. 1.
Figure 3:
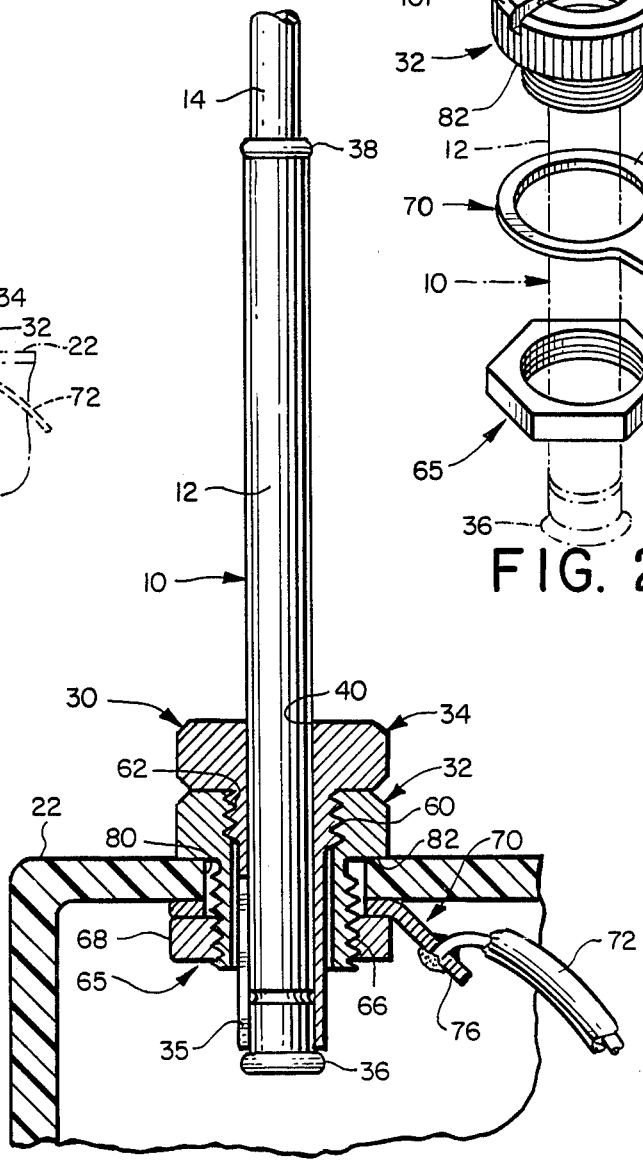
FIG. 3 is an enlarged side elevation, partially in section, illustrating further details of the mounting of the antenna of FIGS. 1 and 2 to a radio body.
Figure 4:
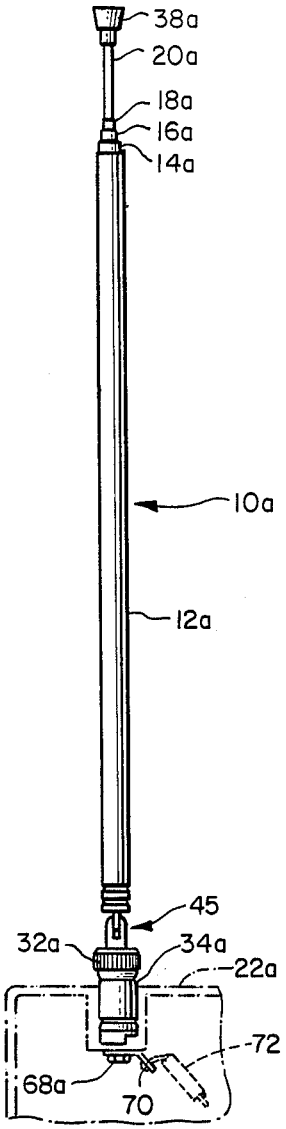
FIG. 4 is a side elevation similar to FIG. 1 illustrating a second embodiment of a removable rod antenna in accordance with the invention, with a portion of a radio body to which it is mounted indicated in phantom line.
Figure 5:
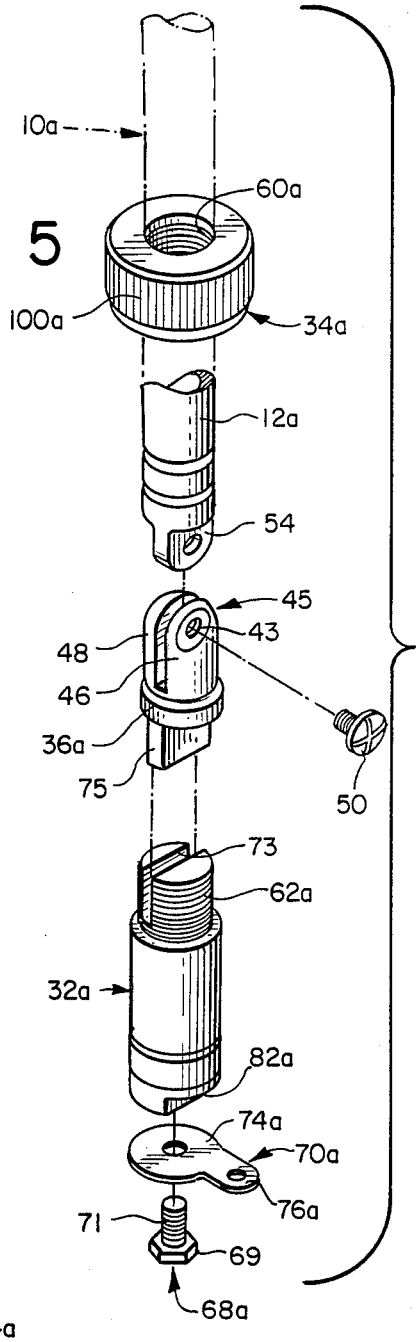
FIG. 5 is an enlarged, exploded partial perspective view illustrating details of the assembly of the antenna of FIG. 4.
Figure 6:
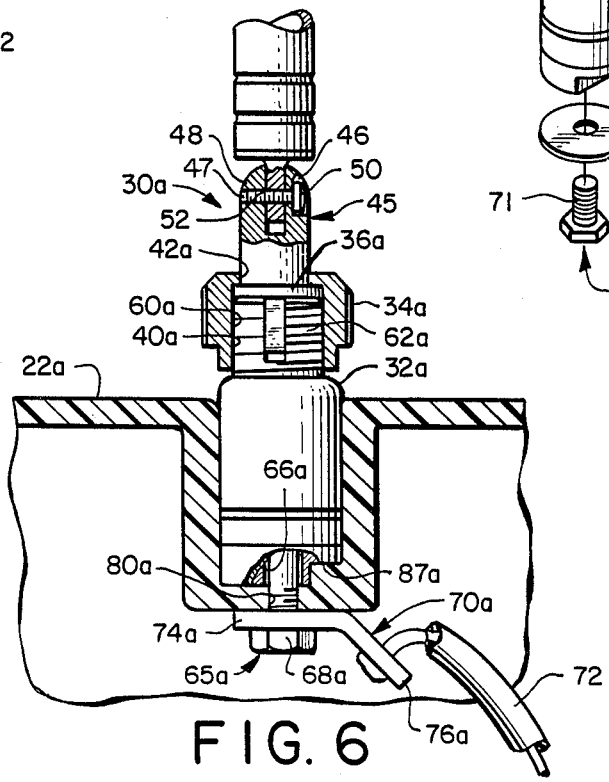
FIG. 6 is an enlarged side elevation, partly broken away and partly in section, illustrating further details of the antenna of FIGS. 4 and 5 mounted to a radio body.

Referring now to the drawings and initially to FIGS. 1 through 3, a removable antenna in accordance with a first embodiment of the invention is illustrated. The remaining FIGS. 4 through 6 illustrate a second embodiment of an antenna in accordance with the invention, whereby like reference numerals, together with the suffix a are utilized in FIGS. 4 through 6 to indicate elements thereof which perform similar functions to the similarly designated elements of the embodiment of FIGS. 1 through 3. In this regard, it will be appreciated from the following description that the two forms of antenna shown in FIGS. 1 through 3 and FIGS. 4 through 6 respectively have many common features, although structural details thereof differ in some respects.

The antenna of FIGS. 1 through 3 will be seen to comprise a telescoping rod-type of antenna designated generally by the reference numeral 10 and comprising a plurality of telescopically nested antenna segments 12, 14, 16, 18 and 20 of decreasing diameter. The antenna of FIG. 4 also comprises such a telescoping antenna as generally indicated by reference numeral 10*a* and similarly indicated telescopically nested segments 12*a*, 14*a*, 16*a*, 18*a* and 20*a*. Both antennas are mounted for extension and retraction both by the telescoping extension and collapsing of the segments thereof and by other means, relative to a radio body or housing 22 which is only partially indicated in the drawings. In this regard, the antenna of FIGS. 1 through 3 is slidably mounted to a fitting structure 30 in accordance with the invention so as to be slidably movable inwardly and outwardly relative to the interior of the housing or radio body 22. On the other hand, a second fitting structure 30*a* in accordance with the second embodiment of the invention shown in FIGS. 4 through 6 pivotally mounts antenna 10*a* to radio body or housing 22*a* so as to be collapsible and extendable by pivotally folding over the antenna relative to the radio housing or body.

Moreover, the antenna 10 of FIGS. 1 through 3 has a loading coil 24 mounted thereto at a suitable mid portion of the telescoping body 10, and specifically about an upper portion of segment 14, for extending the effective length thereof. On the other hand, the telescoping antenna of FIGS. 4 through 6 is not of this type and hence not so constructed having no loading coil.

Turning now to the fitting structure or assembly 30 for assembling the antennas 10 and 10*a* to the radio bodies 22 and 22*a*, it will be seen that these fittings, although different in their details, are functionally similar. Accordingly, first fitting means 32, 32*a* are rigidly coupled with the radio body in a manner to be more fully described later. Second fitting means 34, 34*a* are held in captive relation on the antenna body 10, 10*a*, also in a manner to be more fully described later. These second fitting means 34, 34*a* are of a complementary configuration for removably engaging the respective first fitting means 32, 32*a*.

Retaining means for holding the respective second fittings 34, 34*a* on the antenna bodies 10, 10*a* generally comprise increased diameter lower end portions 36, 36*a* at one end portion of the antenna bodies and a second increased diameter portions 38, 38*a* on a location axially spaced from portions 36, 36*a* on the antenna body. In the embodiment of FIG. 3, the fitting 34 has a central through bore 40 which is slidably engaged with the largest or base antenna segment 12. The end stop 36 comprises an increased diameter knob-like member which may be engaged by a press fit or otherwise with a lowermost end of segment 12. The second retaining means or stop comprises a similar enlarged diameter portion 38 formed at an opposite end of segment 12.

In the embodiment of FIGS. 4 through 6, the second fitting means 34*a* has a similar through bore 40*a* which has a decreased diameter radially inwardly extending shoulder portion 42*a* at its uppermost portion. This shoulder 42*a* engages an increased diameter radially outwardly extending shoulder portion 36*a* formed on a bracket member 45 to which the antenna body 10*a* is pivotally mounted. In this regard, bracket 45 comprises a pair of parallel and spaced apart upstanding legs 46, 48, of which have aligned through apertures 43, 47 at least one of which is threaded to receive an externally threaded fastener or screw 50 therethrough. Preferably, the leg 48 is provided with the threaded tapped aperture 52 to receive the screw 50. Cooperatively, a bottommost portion of antenna segment 12*a* is provided with a downwardly extending through apertured tab or ear 54 which readily interfits intermediate upstanding members 46 and 48 and accepts the body of screw 50 therethrough so as to render the antenna 10*a* pivotally movable relative to bracket 45. The bracket 45 is also keyed to the first fitting 32*a* for non-rotatable mounting relative thereto. In this regard, first fitting 32*a* has its externally threaded portion 62*a* slotted as indicated at 73 to receive a downwardly extending complementary formed tab or ear 75 of bracket 45.

Hence, as previously mentioned, it will be seen that the antenna of FIGS. 1 through 3 is slidably partially retractable within the housing or radio body 22 while the antenna of FIGS. 4 through 6 is collapsible by pivotally collapsing the antenna into a flat condition against the radio body or housing 22*a*.

In accordance with a further feature of the invention, mating coupling means comprising respective mating threads 60, 62 and 60*a*, 62*a* are formed respectively on the first and second fitting means 32, 34 and 32*a*, 34*a* for engaging each other in electrically conductive contact. This serves to removably mount the antennas 10 and 10*a* to the radio bodies 22 and 22*a* in conductive contact with the first fitting means 32, 32*a* which are respectively rigidly mounted to the radio bodies or housings. Both of the fitting assemblies 30, 30*a* mount terminals 70, 70*a* interiorally of the radio body or housing to accomodate an electrical conductor or lead wire 72 from the antenna to the radio circuits. Accordingly, terminal mounting means designated generally by reference numerals 65, 65*a* mount the respective terminals 70, 70*a*. It will be seen that both terminals 70 and 70*a* generally comprise annular bodies 74, 74*a* having radially outwardly extending connector portions 76, 76*a*. Cooperatively, the terminal mounting means 65, 65*a* comprise a first threaded fastener portion 66, 66*a* formed on the first fitting means 32, 32*a* and a mating threaded fastener 68, 68*a* of complimentary form for mating with the threaded fastener portions 66, 66*a* respectively. It will be seen that one of these mating fastener members or portions are externally threaded and the other internally threaded, the externally threaded one being of complimentary outer diameter for receiving the annular member or portion 74, 74*a* of the terminal therearound. Moreover, upon advancement of the threaded fastener 68, 68*a* relative to the threaded fastener portion 66, 66*a*, the annular portion 74, 74*a* is engaged in electrically conductive contact with at least the threaded fastener 68, 68*a*.

The threaded fastener 68 of the embodiment of FIGS. 1 through 3 comprises a nut-like internally threaded fastener member which engages with an externally threaded portion 66 of fitting 32. In the embodiment of FIGS. 4 through 6, the threaded fastener 68*a* comprises a screw or bolt-like externally threaded fastener member having an enlarged head portion 69 for engaging the terminal member 70*a* and a threaded shank portion 71 for threadably engaging internally threaded portion 66*a* of fitting 32*a*.

The externally threaded portion 66 of the embodiment of FIGS. 1 through 3 further extends through a through aperture 80 in the radio body 22. In similar fashion the externally threaded shank portion 69 of fastener 68*a* extends through a through aperture 80*a* in the radio body 22*a* of the embodiment of FIGS. 4 through 6. Cooperatively, the annular portions 74, 74*a* of terminal members 70, 72 are respectively of a diameter at least as great as the cross-sectional dimension of the associated through aperture 80, 80*a* for receiving the respective externally threaded members therethrough. Cooperatively, the first fittings 32, 32*a* have respective enlarged diameter shoulder portions 82, 82*a* for engaging the radio body at one end of the through apertures 80, 80*a*. Hence, the radio body is engaged about this through aperture between the terminal annular portion 74, 74*a* on the one side and the shoulder portion 82, 82*a* on the other side when the fastener member 68, 68*a* is fully advanced relative to the first fitting member 32, 32*a*. This full fastener advancement also results in the rigid mounting of the first fitting 32, 32*a* to the radio body 22, 22*a*.

In the embodiment of FIGS. 1 through 3, the first and second fittings 32, 34 have coaxially alignable through openings 90, 92 which extend respectively interiorally of the radio body 22 when the fittings are mounted thereto as illustrated in FIGS. 3. Preferably, the later opening 92 extends through a downwardly depending split sleeve or skirt portion 35. This skirt 35 is provided to facilitate the slidably mounted movement of second fitting 34 relative to segment 12 of the antenna body 10. This skirt 35 is sized so as to resiliently grippingly engage antenna segment 12 so as to hold antenna segment 12 is a fixed position relative to fitting 34 when the latter is assembled with fitting 32 and coupled with the radio body as shown in FIG. 3. This engagement between skirt 35 and antenna body segment 12 also defines the amount of retraction of the antenna body 10 relative to the radio body 22. Accordingly, the antenna body 10 is slidable with respective to the aligned through openings 90, 92 for at least partial retraction thereof within the radio body 22 as previously mentioned.

On the other hand, as mentioned with respect to the embodiment of FIGS. 4 through 6, the mounting bracket 45 and pivotal mounting thereof by means of the screw or other fastener 50 permits the antenna 10*a* to be moved between a collapsed and extended position by pivoting relative to the radio body 22*a*.

Both of the second fitting means 34, 34*a* have manually graspable means, in the form of peripheral knurled surface portions 100, 100*a* for manually grasping to effect engagement and disengagement thereof with the respective first fitting means 32, 32*a* manually and without the need for any tool or the like. In the embodiment of FIGS. 1–3, fitting 32 is also provided with a knurl 101 to permit manual engagement and disengagement with nut 68.

While particular embodiments of the invention have been shown and described, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. a removable rod antenna comprising: first fitting means for rigidly mounting to a radio body; elongate antenna body means; second fitting means of complementary configuration to the configuration of said first fitting means for removably engaging said first fitting means; a retaining means for holding said second fitting means in captive relation on said antenna body means, such that the antenna is completely removed from the radio body both mechanically and electrically upon disengagement of the second fitting means from the first fitting means; and mating coupling means defined respectively on said first and second fitting means for casing the first and second fitting means to be engaged in electrically conductive contact with each other so as to thereby removably mount said antenna body means to said radio body and in conductive contact with said first fitting means which first fitting means is rigidly mounted to the radio body; a terminal comprising a generally annular member having a radially outwardly extending connector portion; and terminal mounting means comprising a first threaded fastener portion formed on said first fitting means and a threaded fastener of complementary form to, and for mating with, said first threaded fastener portion; one of said first threaded fastener portion and said threaded fastener comprising an externally threaded member of complementary outer diameter to, and for receiving, said annular member closely fitted therearound and, for engaging said annular member in electrically conductive contact with at least said threaded fastener and for rigidly coupling said first fitting means to the radio body; wherein said antenna body means comprises an elongate cylindrical body; wherein said second fitting means has a generally cylindrical, depending, slotted skirt for frictionally engaging and slideably receiving said elongate cylindrical body therethrough; and wherein said retaining means includes respective increased diameter portions at axially spaced locations on said antenna body means of diameter greater than that of said depending skirt of said second fitting means.

2. An antenna according to claim 1 wherein said mating coupling means comprises a threaded portion on said first fitting means and a mating threaded portion on said second fitting means for threaded engagement with the threaded portion on said first fitting means.

3. An antenna according to claim 1 wherein said antenna body means comprises a plurality of telescopically engaged antenna sections, said second fitting means being slideably engaged about an outermost one of said sections.

4. An antenna according to claim 1 wherein said first and second fitting means have complementary engageable threads thereon comprising said mating coupling means and wherein said second fitting means further includes a shoulder portion for engaging the first fitting means as the second fitting means is advanced relative to the first fitting means, thereby defining maximum advancement of said second fitting means relative to said first fitting means.

5. An antenna according to claim 1 wherein said first and second fitting means have coaxially alignable through openings, said through opening of said second fitting means extending interiorly of said radio body, said antenna body means being slideable with respect to said aligned through openings for at least partial retraction thereof within said radio body.

6. An antenna according to claim 1, wherein said second fitting means includes manually graspable means accessible to an operator for engagement and disengagement thereof with said first fitting means manually and without the need for any tool or the like.

7. An antenna according to claim 4 wherein said second fitting means is externally threaded and has a shoulder portion extending radially outwardly of said external thread.

8. An antenna according to claim 5 wherein said retaining means comprises respective increased diameter portions at one axial end of said antenna body means and at a location thereon axially spaced from said one axial end, and of greater diameter than the diameter of said second fitting means through opening.

* * * * *